US011752602B2

(12) United States Patent
Huang et al.

(10) Patent No.: US 11,752,602 B2
(45) Date of Patent: Sep. 12, 2023

(54) PEEP-HOLE SOCKET DRIVING SHANK ASSEMBLY

(71) Applicants: Hsuan-Yu Huang, Taichung (TW); Bing-Cheng Liao, Taichung (TW)

(72) Inventors: Hsuan-Yu Huang, Taichung (TW); Bing-Cheng Liao, Taichung (TW)

( * ) Notice: Subject to any disclaimer, the term of this patent is extended or adjusted under 35 U.S.C. 154(b) by 39 days.

(21) Appl. No.: 17/552,596

(22) Filed: Dec. 16, 2021

(65) Prior Publication Data

US 2023/0191564 A1 Jun. 22, 2023

(51) Int. Cl.
*B25B 21/00* (2006.01)
*B25B 23/00* (2006.01)

(52) U.S. Cl.
CPC ..... *B25B 21/002* (2013.01); *B25B 23/0035* (2013.01)

(58) Field of Classification Search
CPC ..... B25B 23/0035; B25B 23/0021; B25B 13/481; B25B 13/06; B25B 21/002
USPC ..... 81/121.1, 177.2
See application file for complete search history.

(56) References Cited

U.S. PATENT DOCUMENTS 4,730,960 A * 3/1988 Lewis ..... B25B 23/0021 408/127
2007/0277652 A1* 12/2007 Tuan-Mu ..... B25B 13/463 81/63

* cited by examiner

*Primary Examiner* — Brian D Keller
*Assistant Examiner* — Robert C Moore
(74) *Attorney, Agent, or Firm* — Karin L. Williams; Alan D. Kamrath; Mayer & Williams PC

(57) ABSTRACT

A driving shank assembly includes a tube, a drive head, a connector, two quick release nuts, and two fastening caps. The tube has two mounting portions each provided with a mounting recess for mounting the drive head and the connector respectively. The two quick release nuts are locked onto the two mounting portions of the tube respectively. The two fastening caps are locked onto the two quick release nuts respectively. Each of the two fastening caps has interior provided with an inner stepped edge. The drive head is provided with a stepped positioning edge abutting the inner stepped edge of one of the two fastening caps. The connector is provided with a stepped positioning edge abutting the inner stepped edge of the other one of the two fastening caps.

7 Claims, 13 Drawing Sheets

R-R

S - S

Z-Z

PEEP-HOLE SOCKET DRIVING SHANK ASSEMBLY

BACKGROUND OF THE INVENTION

1. Field of the Invention

The present invention relates to a hand tool and, more particularly, to a deep-hole socket driving shank assembly.

2. Description of the Related Art

A conventional deep-hole socket driving shank assembly comprises a tube having a first end provided with a driving head, and a connecting member having a first end secured to a second end of the tube by welding and a second end provided with a shank. The driving head is provided with a driving recess. The shank is provided with an annular groove for locking an electric tool. In practice, two bolts are mounted on a ceiling. A support plate is mounted between the two bolts. Two nuts are screwed onto the two bolts and rest on the bottom of the support plate to support the support plate. Thus, the support plate is used to support a vent pipe or a fire hose. The driving recess of the driving head is mounted on each of the two nuts. The electric tool is connected with the shank of the connecting member. In operation, the connecting member is driven by the electric tool to rotate the tube which rotates the driving head which rotates each of the two nuts so that each of the two nuts is screwed onto or unscrewed from each of the two bolts. However, the tube and the connecting member are not coaxial and have a poor circularity therebetween so that the tube is easily deflected during rotation. In addition, the tube, the driving head, and the connecting member are formed integrally so that the tube, the driving head, and the connecting member cannot be dismantled, so that the driving head is not available for nuts of different sizes and specifications. Further, it is necessary replace the whole socket driving shank assembly when the driving head or the connecting member is worn out or broken, thereby causing a waste of material, and thereby increasing the cost of replacement and maintenance.

BRIEF SUMMARY OF THE INVENTION

In accordance with the present invention, there is provided a driving shank assembly comprising a tube, a drive head, a connector, two quick release nuts, and two fastening caps. The tube has two mounting portions formed on two ends thereof. Each of the two mounting portions of the tube has an interior provided with a mounting recess for mounting the drive head and the connector respectively. The two quick release nuts are locked onto the two mounting portions of the tube respectively. The two fastening caps are locked onto the two quick release nuts respectively. Each of the two fastening caps has interior provided with an inner stepped edge. The drive head is provided with a fitting portion mounted in the mounting recess of one of the two mounting portions of the tube so that the tube and the drive head are combined integrally. The drive head is provided with a stepped positioning edge abutting the inner stepped edge of one of the two fastening caps. The connector is provided with a fitting portion mounted in the mounting recess of the other one of the two mounting portions of the tube so that the tube and the connector are combined integrally. The connector is provided with a stepped positioning edge abutting the inner stepped edge of the other one of the two fastening caps.

According to the primary advantage of the present invention, the tube, the drive head, and the connector are coaxial with each other and have a precise circularity therebetween so that the driving shank assembly is driven by the electric tool steadily and will not be deflected during rotation, thereby facilitating the user operating the driving shank assembly.

According to another advantage of the present invention, the tube, the drive head, and the connector are assembled detachably so that the tube cooperates with the drive head and the connector of different sizes and specifications so that the driving shank assembly is available for operating nuts of different types.

According to a further advantage of the present invention, when the drive head or the connector is worn out or broken, the user only needs to replace the drive head or the connector without having to replace the driving shank assembly, thereby saving the cost.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
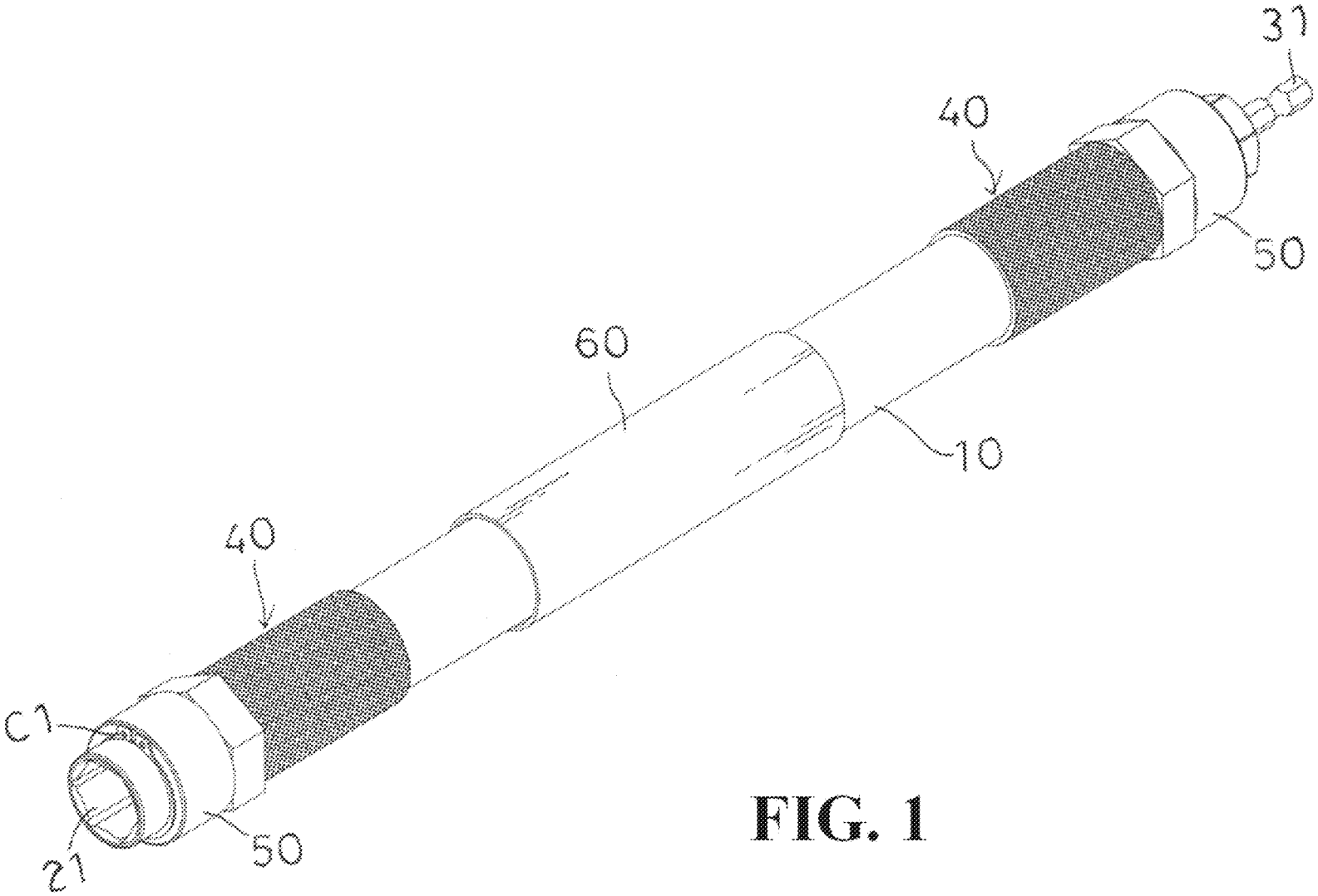
FIG. 1 is a front perspective view of a driving shank assembly in accordance with the first preferred embodiment of the present invention.
Figure 2:
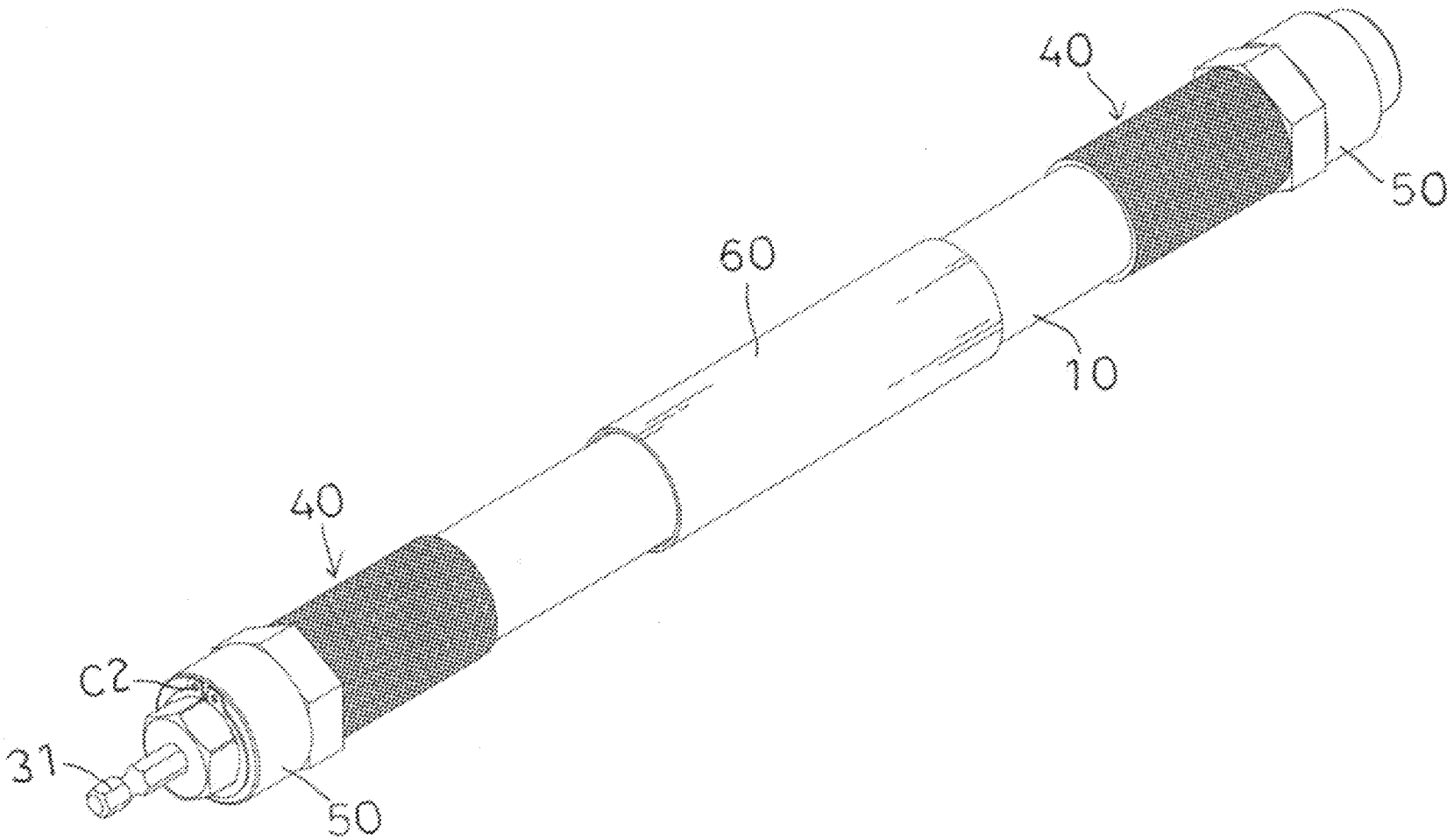
FIG. 2 is a rear perspective view of the driving shank assembly in accordance with the first preferred embodiment of the present invention.
Figure 3:
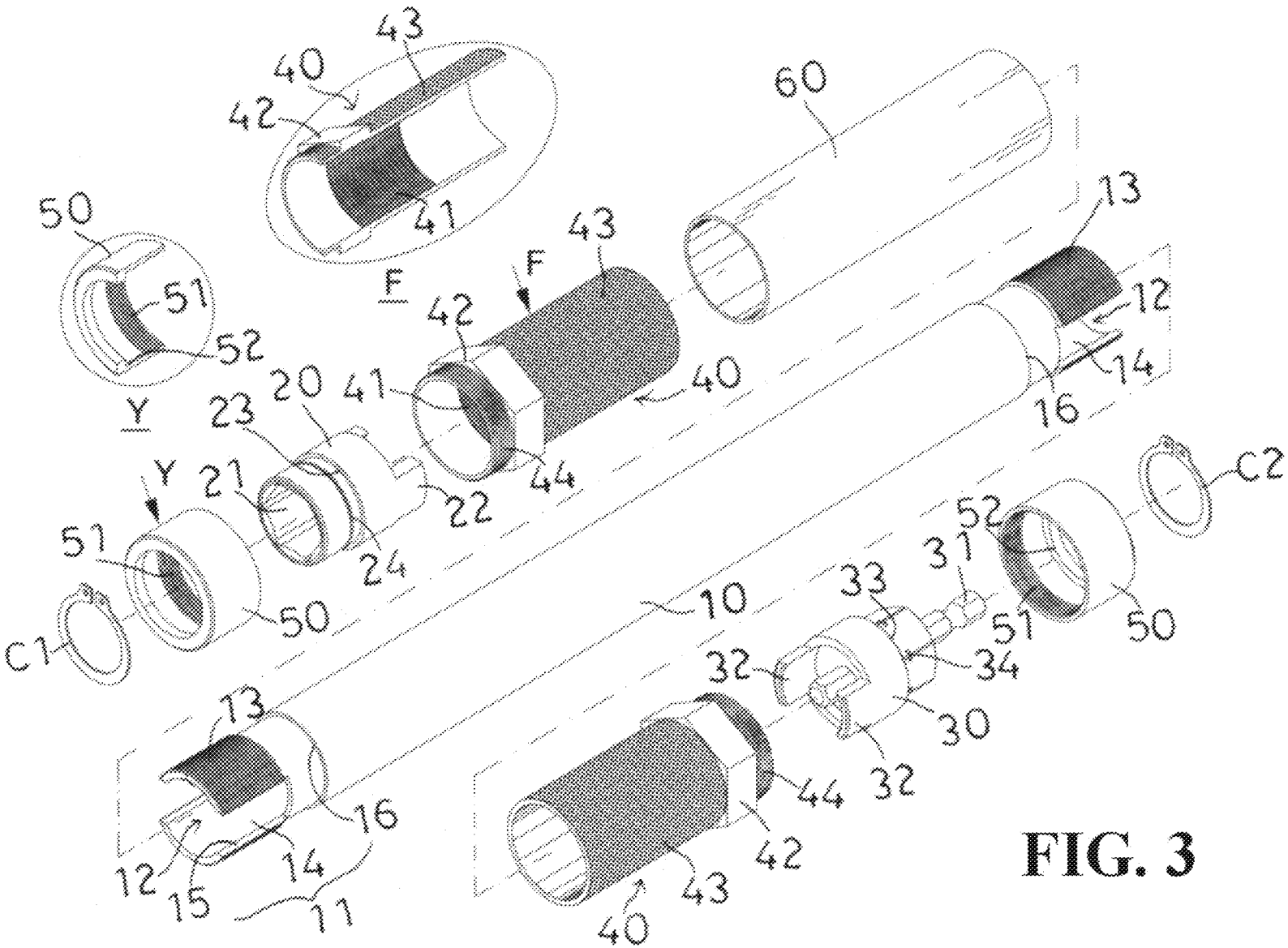
FIG. 3 is an exploded perspective view of the driving shank assembly in accordance with the first preferred embodiment of the present invention, wherein enlarged perspective broken views along marks F and Y are included.
Figure 5:
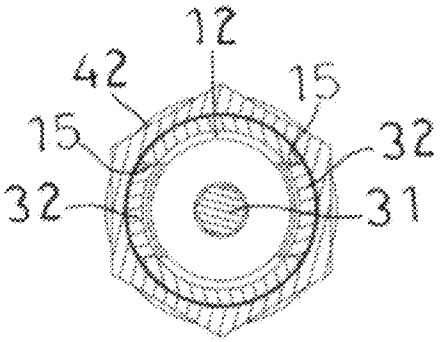
FIG. 5 is a cross-sectional view of the driving shank assembly taken along line R-R as shown in FIG. 4.
Figure 4:
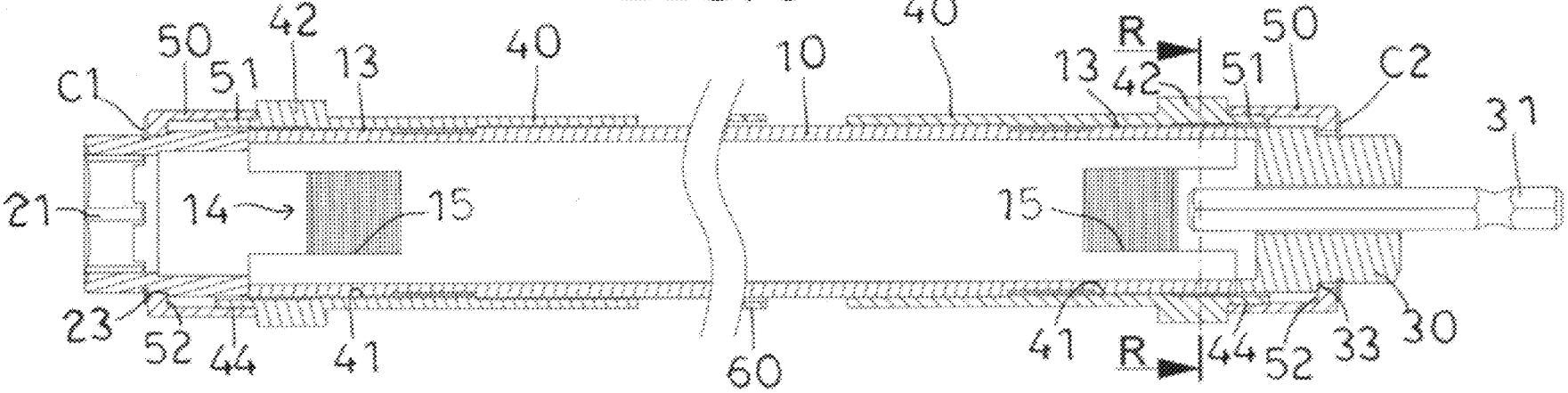
FIG. 4 is a cross-sectional view of the driving shank assembly in accordance with the first preferred embodiment of the present invention.

Referring to the drawings and initially to FIGS. 1-5, a driving shank assembly in accordance with the preferred embodiment of the present invention comprises a tube 10, a drive head 20, a connector 30, two quick release nuts 40, and two fastening caps 50.

The tube 10 is hollow and has a straight shape. The tube 10 has two mounting portions 11 formed on two ends thereof. Each of the two mounting portions 11 of the tube 10 has an interior provided with a mounting recess 12 for mounting the drive head 20 and the connector 30 respectively.

The two quick release nuts 40 are locked onto the two mounting portions 11 of the tube 10 respectively.

The two fastening caps 50 are locked onto the two quick release nuts 40 respectively. Each of the two fastening caps 50 has interior provided with an inner stepped edge 52.

The drive head 20 is provided with a fitting portion mounted in the mounting recess 12 of one of the two mounting portions 11 of the tube 10 so that the tube 10 and the drive head 20 are combined integrally. The drive head 20 is provided with a stepped positioning edge 23 abutting the inner stepped edge 52 of one of the two fastening caps 50 to position one of the two fastening caps 50.

The connector 30 is provided with a fitting portion mounted in the mounting recess 12 of the other one of the two mounting portions 11 of the tube 10 so that the tube 10 and the connector 30 are combined integrally. The connector 30 is provided with a stepped positioning edge 33 abutting the inner stepped edge 52 of the other one of the two fastening caps 50 to position the other one of the two fastening caps 50.

In the preferred embodiment of the present invention, the mounting recess 12 of each of the two mounting portions 11 of the tube 10 has a circular shape, the fitting portion of the drive head 20 has a circular shape, and the fitting portion of the connector 30 has a circular shape. Each of the two mounting portions 11 of the tube 10 has a periphery provided with multiple positioning slots 14 extending along an axis of the tube 10. The fitting portion of the drive head 20 is provided with multiple positioning projections 22 inserted into and positioned in the positioning slots 14 of one of the two mounting portions 11 of the tube 10 so that the tube 10 and the drive head 20 are combined integrally. The fitting portion of the connector 30 is provided with multiple positioning projections 32 inserted into and positioned in the positioning slots 14 of the other one of the two mounting portions 11 of the tube 10 so that the tube 10 and the connector 30 are combined integrally.

In another preferred embodiment of the present invention, the mounting recess 12 of each of the two mounting portions 11 of the tube 10 has a noncircular shape, including a square shape or hexagonal shape, the fitting portion of the drive head 20 has a noncircular shape, including a square shape or hexagonal shape, and the fitting portion of the connector 30 has a noncircular shape, including a square shape or hexagonal shape.

In the preferred embodiment of the present invention, the driving shank assembly further comprises a holding cylinder (or sleeve or barrel) 60 rotatably mounted on the tube 10. Thus, the holding cylinder 60 is not rotated with the tube 10 to facilitate a user holding the holding cylinder 60 when the tube 10 is rotated.

In the preferred embodiment of the present invention, the drive head 20 has a periphery provided with an annular groove 24, and the driving shank assembly further comprises a first C-shaped snap ring C1 snapped into and retained in the annular groove 24 of the drive head 20.

In the preferred embodiment of the present invention, the connector 30 has a periphery provided with an annular groove 34, and the driving shank assembly further comprises a second C-shaped snap ring C2 snapped into and retained in the annular groove 34 of the connector 30.

In the preferred embodiment of the present invention, the tube 10 is provided with two outer stepped edges 16. Each of the two outer stepped edges 16 is located at a connection of the tube 10 and one of the two mounting portions 11. Each of the two quick release nuts 40 is moved to touch one of the two outer stepped edges 16 of the tube 10 to prevent an excessive movement of each of the two quick release nuts 40 on the tube 10.

In the preferred embodiment of the present invention, each of the two mounting portions 11 has an exterior provided with a first external thread 13 for locking and securing each of the two quick release nuts 40.

In the preferred embodiment of the present invention, each of the positioning slots 14 of the tube 10 is provided with a positioning face 15 having a substantially U-shaped profile.

In the preferred embodiment of the present invention, the drive head 20 has a first end provided with a driving recess 21 and a second end provided with the positioning projections 22. The driving recess 21 of the drive head 20 has a hexagonal shape or a square shape. The driving recess 21 of the drive head 20 is available for nuts of different sizes and specifications.

Figure 12:
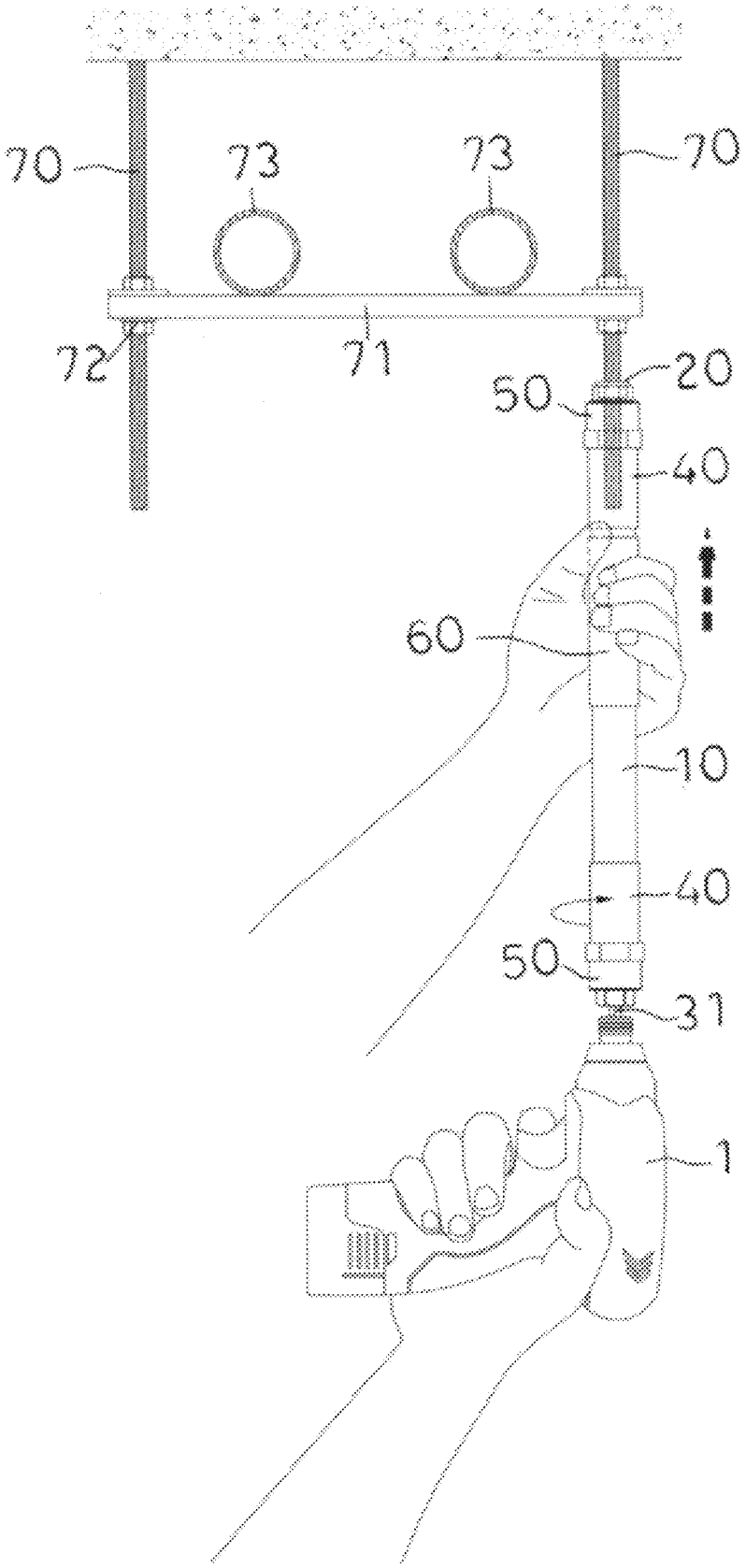
FIG. 12 is a schematic cross-sectional view showing operation of the driving shank assembly using an electric tool.
Figure 13:
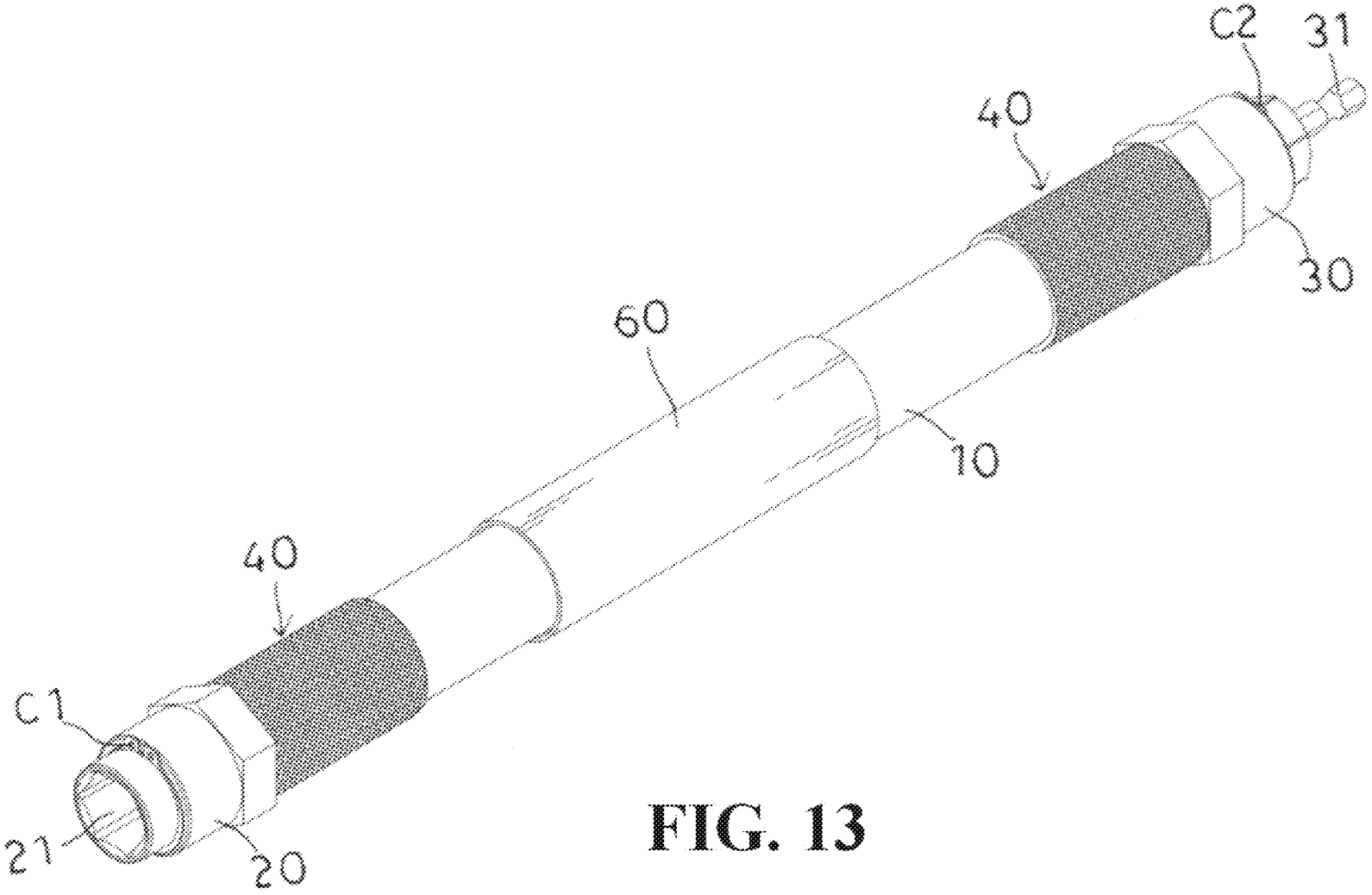
FIG. 13 is a front perspective view of a driving shank assembly in accordance with the second preferred embodiment of the present invention.
Figure 14:
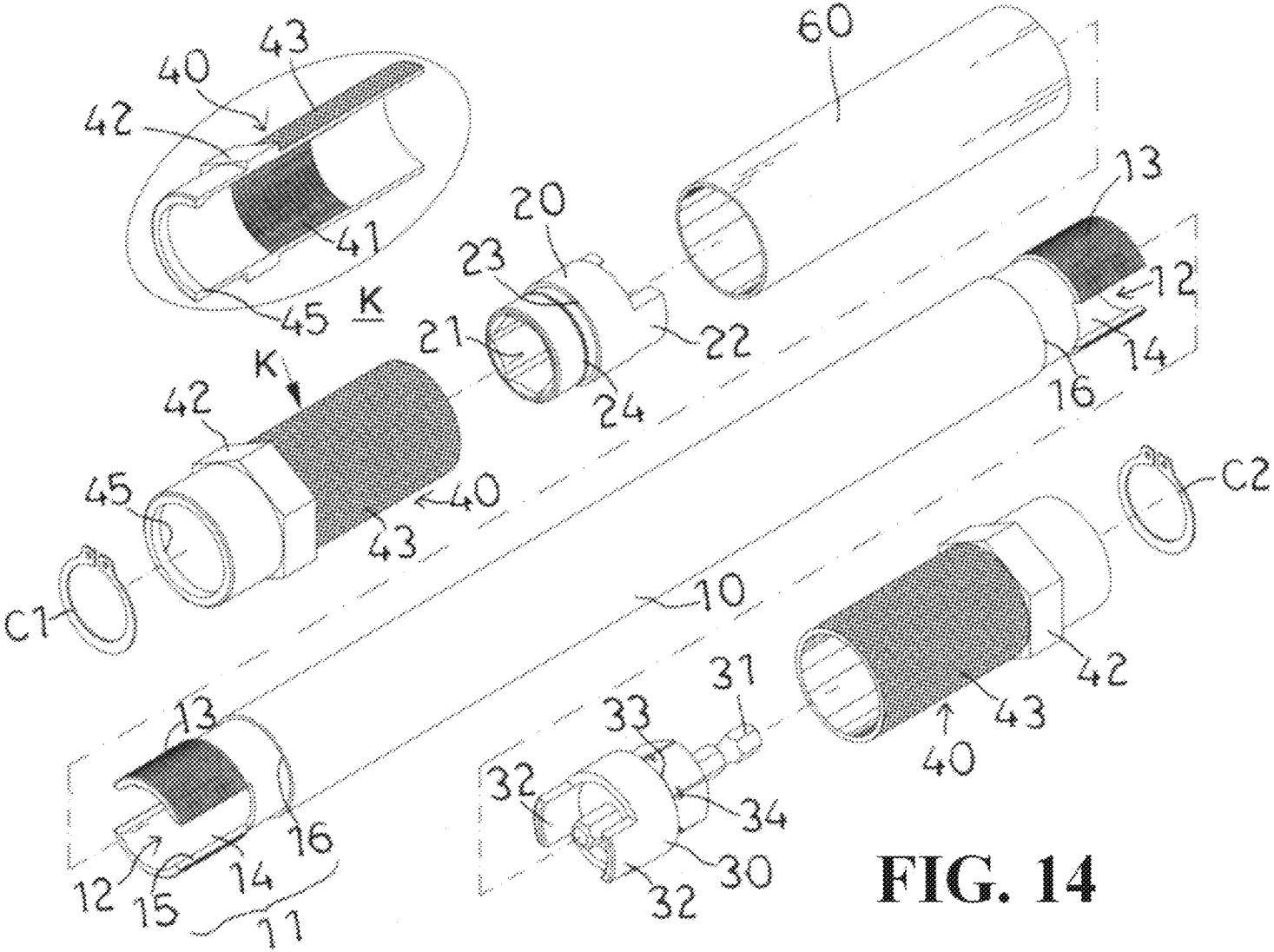
FIG. 14 is an exploded perspective view of the driving shank assembly in accordance with the second preferred embodiment of the present invention, wherein an enlarged perspective broken view along mark K is included.
Figure 16:
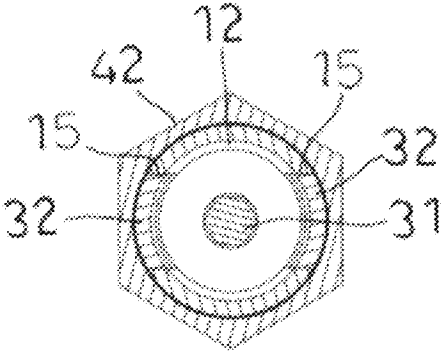
FIG. 16 is a cross-sectional view of the driving shank assembly taken along line S-S as shown in FIG. 15.
Figure 15:
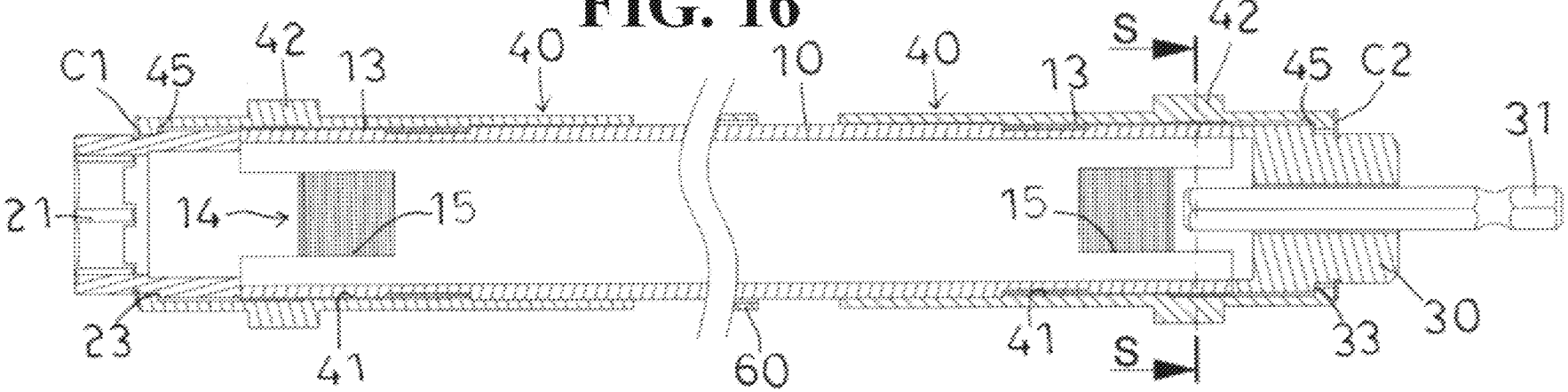
FIG. 15 is a cross-sectional view of the driving shank assembly in accordance with the second preferred embodiment of the present invention.

In the preferred embodiment of the present invention, the connector 30 has a first end provided with a connecting shank 31 and a second end provided with the positioning projections 32. The connecting shank 31 of the connector 30 is provided with an annular retaining groove for mounting an actuating tool, such as an electric tool 1 (FIG. 12).

In the preferred embodiment of the present invention, each of the two quick release nuts 40 has an interior provided with a first internal thread 41 screwed onto the first external thread 13 of the tube 10. The first internal thread 41 of each of the two quick release nuts 40 is moved on the first external thread 13 of the tube 10 until one end of the first internal thread 41 of each of the two quick release nuts 40 touches one of the two outer stepped edges 16 of the tube 10 to prevent an excessive movement of each of the two quick release nuts 40 on the tube 10. Each of the two quick release nuts 40 has an exterior provided with a driving portion 42. Preferably, the driving portion 42 of each of the two quick release nuts 40 has a hexagonal shape. A wrench tool is mounted on the driving portion 42 to drive and rotate each of the two quick release nuts 40. Each of the two quick release nuts 40 has a periphery provided with a knurling (or embossing) portion 43 to increase the friction thereof and to facilitate the user holding and operating each of the two quick release nuts 40. Each of the two quick release nuts 40 is provided with a second external thread 44 for locking each of the two fastening caps 50. The driving portion 42 of each of the two quick release nuts 40 is located between the second external thread 44 and the knurling portion 43.

In the preferred embodiment of the present invention, each of the two fastening caps 50 has an interior provided with a second internal thread 51 screwed onto the second external thread 44 of one of the two quick release nuts 40 so that each of the two fastening caps 50 is locked on one of the two quick release nuts 40.

Figure 6:
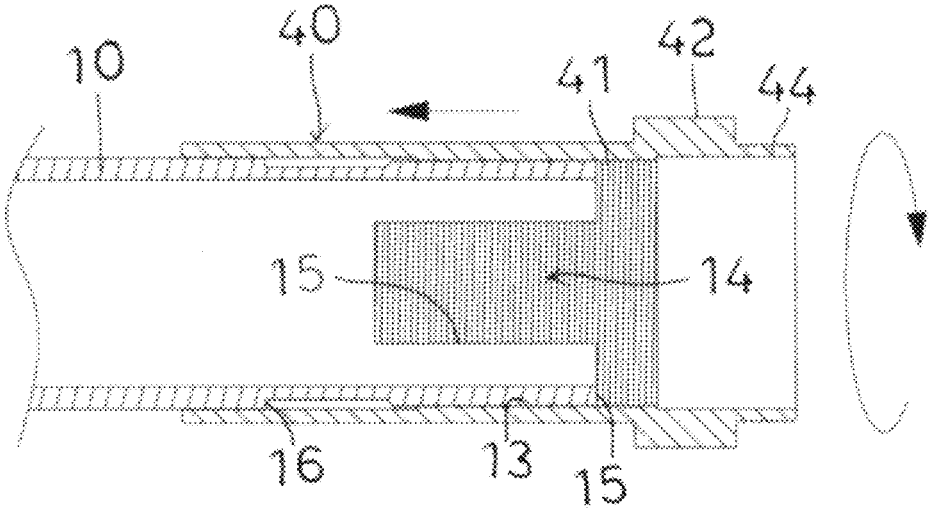
FIG. 6 is a cross-sectional view showing assembly of one of the two quick release nuts of the driving shank assembly in accordance with the first preferred embodiment of the present invention.
Figure 7:
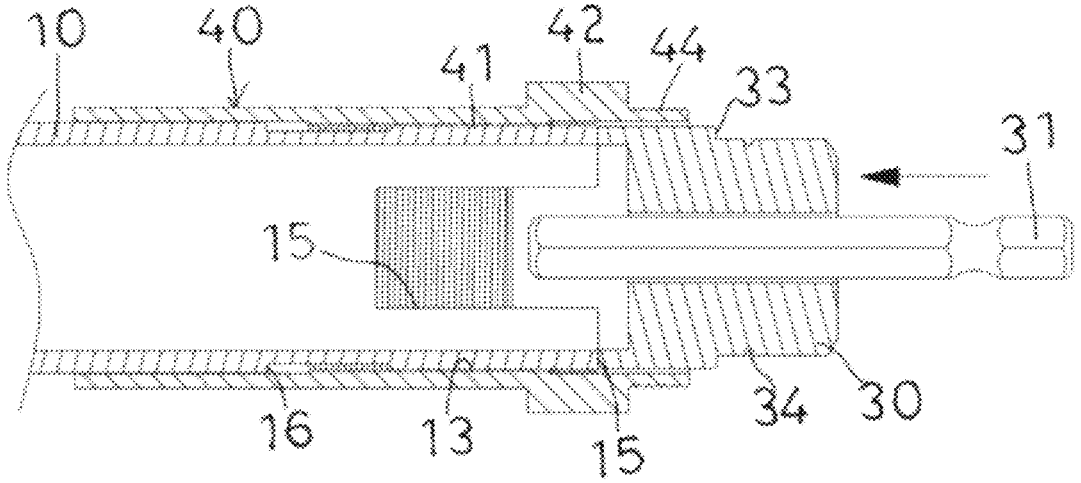
FIG. 7 is a cross-sectional view showing assembly of the connector of the driving shank assembly in accordance with the first preferred embodiment of the present invention.
Figure 8:
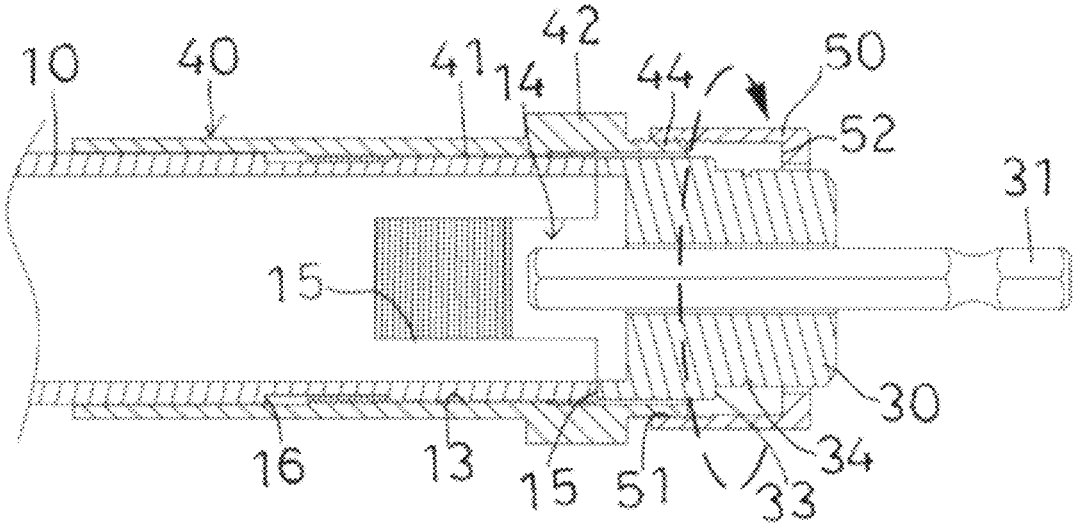
FIG. 8 is a cross-sectional view showing assembly of one of the two fastening caps of the driving shank assembly in accordance with the first preferred embodiment of the present invention.
Figure 9:
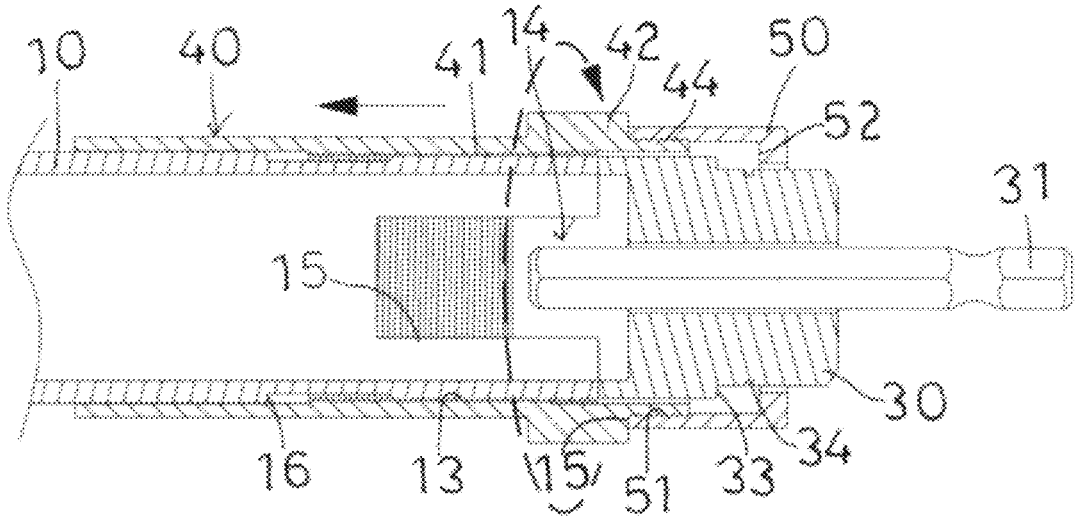
FIG. 9 is a cross-sectional view showing further assembly of one of the two quick release nuts of the driving shank assembly in accordance with the first preferred embodiment of the present invention.
Figure 10:
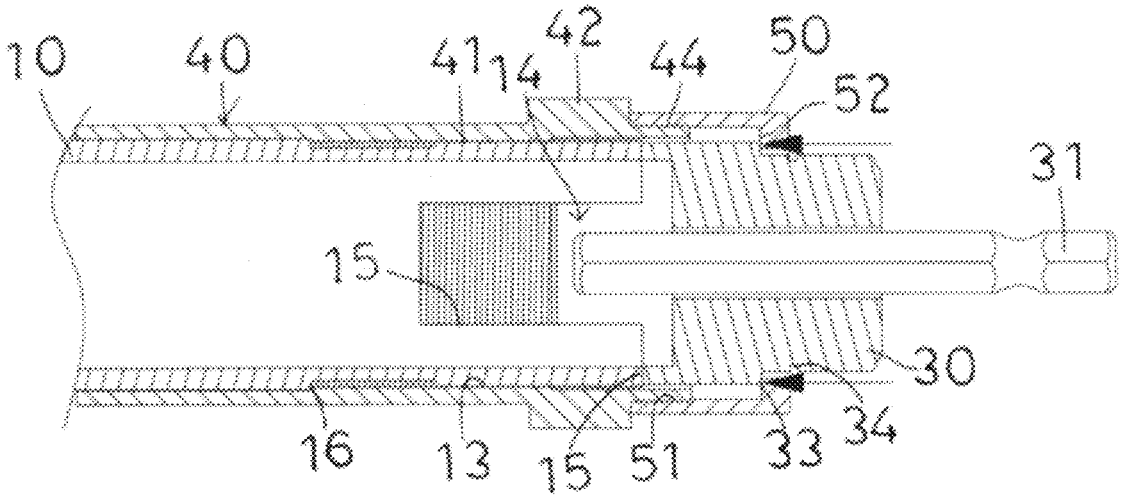
FIG. 10 is a cross-sectional view showing further assembly of one of the two fastening caps of the driving shank assembly in accordance with the first preferred embodiment of the present invention.
Figure 11:
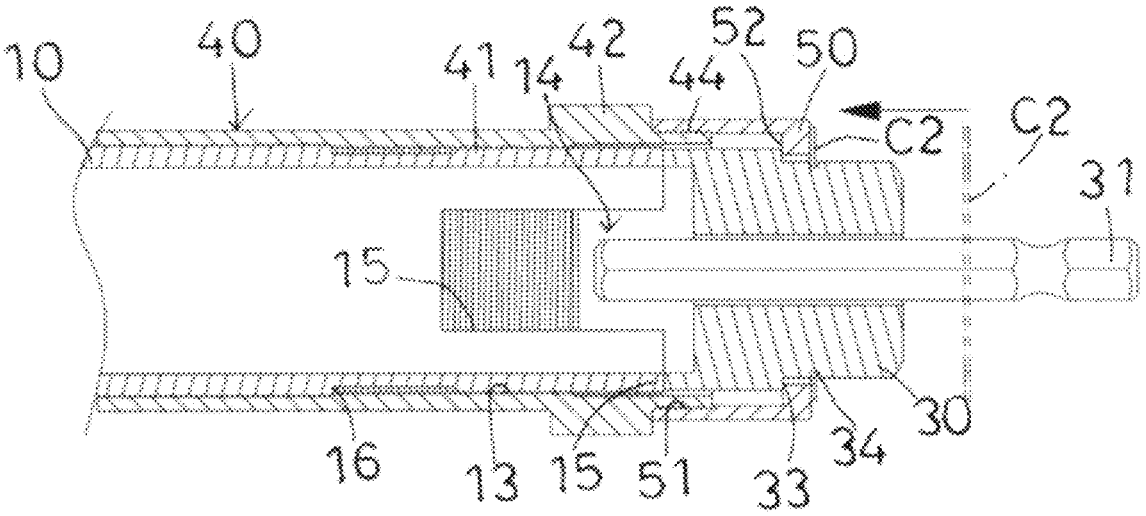
FIG. 11 is a cross-sectional view showing assembly of a second C-shaped snap ring of the driving shank assembly in accordance with the first preferred embodiment of the present invention.

In assembly, referring to FIGS. 6-11 with reference to FIGS. 1-5, each of the two quick release nuts 40 is rotated on the tube 10 so that the first internal thread 41 of each of the two quick release nuts 40 is screwed onto and moved on the first external thread 13 of the tube 10 as shown in FIG. 6. Then, the connector 30 (or the drive head 20) is moved toward the tube 10 as shown in FIG. 7, and the positioning projections 32 of the connector 30 (or the positioning projections 22 of the drive head 20) are inserted into the positioning slots 14 of the one of the two mounting portions 11 of the tube 10 until the connector 30 (or the drive head 20) touches the positioning face 15 of the tube 10 so that the tube 10 and the connector 30 (or the drive head 20) are combined integrally. Then, each of the two fastening caps 50 is rotated on one of the two quick release nuts 40, and the second internal thread 51 of each of the two fastening caps 50 is screwed onto the second external thread 44 of one of the two quick release nuts 40 as shown in FIG. 8 until each of the two fastening caps 50 touches the driving portion 42 of one of the two quick release nuts 40 as shown in FIG. 9, so that each of the two fastening caps 50 is locked on one of the two quick release nuts 40. Then, each of the two quick release nuts 40 is further rotated on the tube 10 as shown in FIG. 9 so that the first internal thread 41 of each of the two quick release nuts 40 is further moved on the first external thread 13 of the tube 10 as shown in FIG. 9. In such a manner, each of the two quick release nuts 40 drives and moves one of the two fastening caps 50 until the inner stepped edge 52 of each of the two fastening caps 50 touches and is positioned on the stepped positioning edge 33 of the connector 30 (or the stepped positioning edge 23 of the drive head 20) as shown in FIG. 10. At this time, when the inner stepped edge 52 of each of the two fastening caps 50 touches the stepped positioning edge 33 of the connector 30 (or the stepped positioning edge 23 of the drive head 20), the annular groove 34 of the connector 30 (or the annular groove 24 of the drive head 20) is exposed from one of the two fastening caps 50, and one end of the first internal thread 41 of each of the two quick release nuts 40 touches one of the two outer stepped edges 16 of the tube 10 as shown in FIG. 10, to prevent an excessive movement of each of the two quick release nuts 40 on the tube 10, and to prevent each of the two quick release nuts 40 from being locked or jammed by rotation of the electric tool 1. Then, the second C-shaped snap ring C2 is snapped into and retained in the annular groove 34 of the connector 30 (or the first C-shaped snap ring C1 snapped into and retained in the annular groove 24 of the drive head 20) as shown in FIG. 11 to secure each of the two fastening caps 50.

In such a manner, the inner stepped edge 52 of each of the two fastening caps 50 touches the stepped positioning edge 33 of the connector 30 (or the stepped positioning edge 23 of the drive head 20), and the second C-shaped snap ring C2 (or the first C-shaped snap ring C1) retains each of the two fastening caps 50, to prevent the connector 30 (or the drive head 20) from being detached by vibration of the electric tool 1. In addition, one end of the first internal thread 41 of each of the two quick release nuts 40 is moved to press one of the two outer stepped edges 16 of the tube 10, to prevent an excessive movement of each of the two quick release nuts 40 on the tube 10, so that when the electric tool 1 drives and moves the connector 30 (or the drive head 20) and the tube 10, the first internal thread 41 of each of the two quick release nuts 40 will not be locked by or jammed with the first external thread 13 of the tube 10.

In practice, referring to FIG. 12 with reference to FIGS. 1-5, two bolts 70 are mounted on a ceiling. A support plate (or rack or bracket) 71 is mounted between the two bolts 70. After the position of the support plate 71 is adjusted, two nuts 72 are screwed onto the two bolts 70 and rest on the bottom of the support plate 71 to support the support plate 71. Thus, the support plate 71 is used to support at least one pipe 73 which is a vent pipe or a fire hose. The driving recess 21 of the drive head 20 is mounted on each of the two nuts 72. At this time, the tube 10 allows passage of each of the two bolts 70. The electric tool 1 is connected with the connecting shank 31 of the connector 30. In operation, the connector 30 is driven by the electric tool 1 to rotate the tube 10 which rotates the drive head 20 which rotates each of the two nuts 72 so that each of the two nuts 72 is screwed onto or unscrewed from each of the two bolts 70. Thus, the driving shank assembly cooperates with the electric tool 1 to operate each of the two nuts 72 easily and quickly. In such a manner, the tube 10, the drive head 20, and the connector 30 are coaxial with each other and have a circularity (or roundness) therebetween so that the driving shank assembly is driven by the electric tool 1 smoothly and steadily and will not be deflected or swayed during rotation.

Accordingly, the tube 10, the drive head 20, and the connector 30 are coaxial with each other and have a precise circularity therebetween so that the driving shank assembly is driven by the electric tool 1 steadily and will not be deflected during rotation, thereby facilitating the user operating the driving shank assembly. In addition, the tube 10, the drive head 20, and the connector 30 are assembled detachably so that the tube 10 cooperates with the drive head 20 and the connector 30 of different sizes and specifications so that the driving shank assembly is available for operating nuts of different types. Further, when the drive head 20 or the connector 30 is worn out or broken, the user only needs to replace the drive head 20 or the connector 30 without having to replace the driving shank assembly, thereby saving the cost. Further, each of the two quick release nuts 40 together each of the two fastening caps 50 is screwed onto the tube 10 to lock the drive head 20 and the connector 30, or unscrewed from the tube 10 to unlock the drive head 20 and the connector 30, so that the drive head 20 and the connector 30 are mounted on and detached from the tube 10 easily and quickly. Further, the drive head 20 and the connector 30 are positioned on the tube 10 solidly and steadily by the two quick release nuts 40 and the two fastening caps 50.

Referring to FIGS. 13-16 with reference to FIGS. 1-5, each of the two quick release nuts 40 and each of the two fastening caps 50 are formed integrally. In practice, each of the two quick release nuts 40 is provided with an inner stepped edge 45 that touches the stepped positioning edge 33 of the connector 30 (or the stepped positioning edge 23 of the drive head 20), to prevent the connector 30 (or the drive head 20) from being detached by vibration of the electric tool 1.

Figure 17:
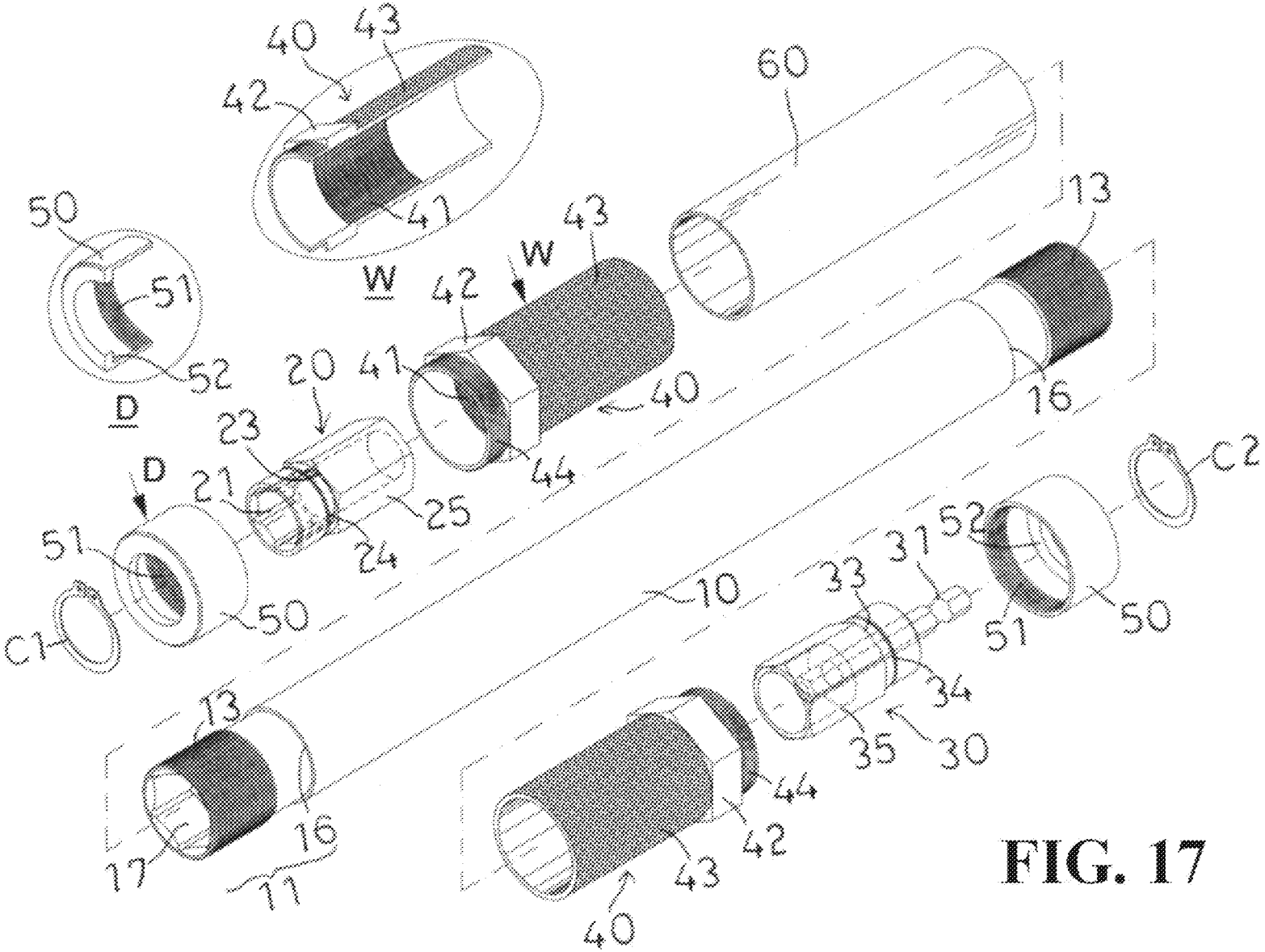
FIG. 17 is an exploded perspective view of the driving shank assembly in accordance with the third preferred embodiment of the present invention, wherein enlarged perspective broken views along marks D and W are included.
Figure 19:
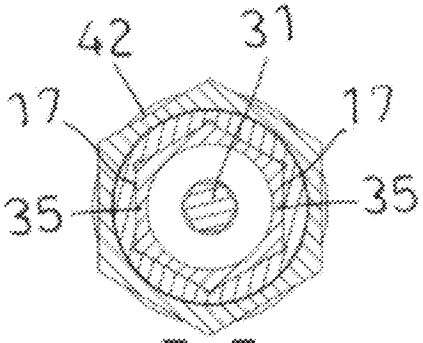
FIG. 19 is a cross-sectional view of the driving shank assembly taken along line Z-Z as shown in FIG. 18.
Figure 18:
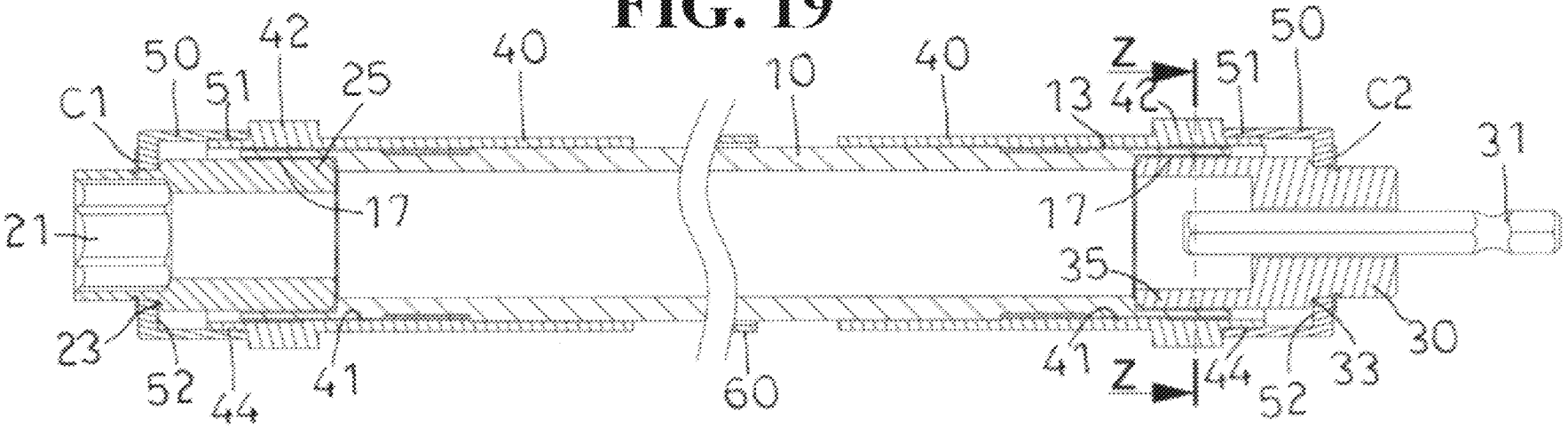
FIG. 18 is a cross-sectional view of the driving shank assembly in accordance with the third preferred embodiment of the present invention.

Referring to FIGS. 17-19 with reference to FIGS. 1-5, each of the two mounting portions 11 of the tube 10 has an interior provided with a hexagonal mounting recess 17 for mounting the drive head 20 and the connector 30 respectively. The drive head 20 is provided with a hexagonal fitting portion 25 mounted in the mounting recess 17 of one of the two mounting portions 11 of the tube 10 so that the tube 10 and the drive head 20 are combined integrally. The connector 30 is provided with a hexagonal fitting portion 35 mounted in the mounting recess 17 of the other one of the two mounting portions 11 of the tube 10 so that the tube 10 and the connector 30 are combined integrally.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A driving shank assembly comprising:

a tube, a drive head, a connector, two quick release nuts, and two fastening caps;

wherein:

the tube has two mounting portions formed on two ends thereof;

each of the two mounting portions of the tube has an interior provided with a mounting recess for mounting the drive head and the connector respectively;

the two quick release nuts are locked onto the two mounting portions of the tube respectively;

the two fastening caps are locked onto the two quick release nuts respectively;

each of the two fastening caps has an interior provided with an inner stepped edge;

the drive head is provided with a fitting portion mounted in the mounting recess of one of the two mounting portions of the tube so that the tube and the drive head are combined integrally;

the drive head is provided with a stepped positioning edge abutting the inner stepped edge of one of the two fastening caps;

the connector is provided with a fitting portion mounted in the mounting recess of the other one of the two mounting portions of the tube so that the tube and the connector are combined integrally; and the connector is provided with a stepped positioning edge abutting the inner stepped edge of the other one of the two fastening caps;

the driving shank assembly further comprises:

a holding cylinder rotatably mounted on the tube;

wherein the holding cylinder is not rotated with the tube to facilitate a user holding the holding cylinder when the tube is rotated.

2. The driving shank assembly as claimed in claim 1, wherein:

the mounting recess of each of the two mounting portions of the tube has a noncircular shape, including a of hexagonal shape;

the fitting portion of the drive head has a noncircular shape, including a hexagonal shape; and the fitting portion of the connector has a noncircular shape, including a hexagonal shape.

3. A driving shank assembly comprising:

a tube, a drive head, a connector, two quick release nuts, and two fastening caps;

wherein:

the tube has two mounting portions formed on two ends thereof;

each of the two mounting portions of the tube has an interior provided with a mounting recess for mounting the drive head and the connector respectively;

the two quick release nuts are locked onto the two mounting portions of the tube respectively;

the two fastening caps are locked onto the two quick release nuts respectively;

each of the two fastening caps has an interior provided with an inner stepped edge;

the drive head is provided with a fitting portion mounted in the mounting recess of one of the two mounting portions of the tube so that the tube and the drive head are combined integrally;

the drive head is provided with a stepped positioning edge abutting the inner stepped edge of one of the two fastening caps;

the connector is provided with a fitting portion mounted in the mounting recess of the other one of the two mounting portions of the tube so that the tube and the connector are combined integrally;

the connector is provided with a stepped positioning edge abutting the inner stepped edge of the other one of the two fastening caps;

the mounting recess of each of the two mounting portions of the tube has a circular shape;

the fitting portion of the drive head has a circular shape;

the fitting portion of the connector has a circular shape;

each of the two mounting portions of the tube has a periphery provided with multiple positioning slots extending along an axis of the tube;

the fitting portion of the drive head is provided with multiple positioning projections inserted into the positioning slots of one of the two mounting portions of the tube so that the tube and the drive head are combined integrally; and the fitting portion of the connector is provided with multiple positioning projections inserted into the positioning slots of the other one of the two mounting portions of the tube so that the tube and the connector are combined integrally.

4. The driving shank assembly as claimed in claim 1, wherein each of the two quick release nuts and each of the two fastening caps are formed integrally.

5. The driving shank assembly as claimed in claim 1, wherein the drive head has a periphery provided with an annular groove, and the driving shank assembly further comprises a first C-shaped snap ring snapped into and retained in the annular groove of the drive head.

6. The driving shank assembly as claimed in claim 1, wherein the connector has a periphery provided with an annular groove, and the driving shank assembly further comprises a second C-shaped snap ring snapped into and retained in the annular groove of the connector.

7. The driving shank assembly as claimed in claim 1, wherein:

the tube is provided with two outer stepped edges;

each of the two outer stepped edges is located at a connection of the tube and one of the two mounting portions; and each of the two quick release nuts is moved to touch one of the two outer stepped edges of the tube to prevent an excessive movement of each of the two quick release nuts on the tube.

* * * * *